US011986061B2

(12) United States Patent
Grimes

(10) Patent No.: US 11,986,061 B2
(45) Date of Patent: May 21, 2024

(54) DEVICE AND METHOD FOR TREATING HEEL PAIN

(71) Applicant: Kevin Grimes, Yorba Linda, CA (US)

(72) Inventor: Kevin Grimes, Yorba Linda, CA (US)

( * ) Notice: Subject to any disclaimer, the term of this patent is extended or adjusted under 35 U.S.C. 154(b) by 0 days.

(21) Appl. No.: 16/734,909

(22) Filed: Jan. 6, 2020

(65) Prior Publication Data

US 2021/0204655 A1 Jul. 8, 2021

(51) Int. Cl.

| | |
|---|---|
| ***A43D 3/02*** | (2006.01) |
| ***A43B 17/16*** | (2006.01) |
| *A43B 7/14* | (2022.01) |
| *A43B 7/1405* | (2022.01) |
| *A43B 7/1415* | (2022.01) |
| *A43B 7/142* | (2022.01) |
| *A43B 7/143* | (2022.01) |
| *A43B 7/1435* | (2022.01) |
| *A43B 7/144* | (2022.01) |
| *A43B 7/1445* | (2022.01) |
| *A43B 7/22* | (2006.01) |
| *A43B 21/51* | (2006.01) |

(52) U.S. Cl.

CPC ..... *A43D 3/021* (2013.01); *A43B 17/16* (2013.01); *A43B 7/14* (2013.01); *A43B 7/1405* (2013.01); *A43B 7/141* (2013.01); *A43B 7/1415* (2013.01); *A43B 7/142* (2013.01); *A43B 7/143* (2013.01); *A43B 7/1435* (2013.01); *A43B 7/144* (2013.01); *A43B 7/1445* (2013.01); *A43B 7/22* (2013.01); *A43B 21/51* (2013.01)

(58) Field of Classification Search

CPC ..... A43B 17/16; A43B 7/14; A43B 7/1405; A43B 7/141; A43B 7/1415; A43B 7/142; A43B 7/143; A43B 7/1435; A43B 7/144; A43B 7/1445; A43B 7/22; A43B 21/51; A43D 3/021

USPC ..... 36/140

See application file for complete search history.

(56) References Cited

U.S. PATENT DOCUMENTS

| | | | | |
|---|---|---|---|---|
| 632,529 A | | 9/1899 | Korwan | |
| 1,860,595 A | * | 5/1932 | Reed | A43B 7/22 36/163 |
| 1,991,444 A | * | 2/1935 | Brogan | A43B 7/1465 36/161 |
| 2,129,321 A | * | 9/1938 | Guerin | A43B 7/22 36/158 |

(Continued)

*Primary Examiner* — Timothy K Trieu
*Assistant Examiner* — Dakota Marin
(74) *Attorney, Agent, or Firm* — Jafari Law Group, Inc.

(57) ABSTRACT

The present invention is an insert having a raised region that contacts an arch region of a wearer's foot, which may be selectively reinforced with a removable supplemental support. In exemplary embodiments, the insert includes a heel region adapted to receive at least a region of a heel of a wearer, and the raised region has a length situated along a width of the insert and adapted to underlie a calcaneus-midtarsal connection of a foot the wearer. The raised region is defined by a bottom semi-cylindrical surface that forms a cavity below the raised region so that an apex of the bottom semi-cylindrical surface lies above a bottom flat surface of the insert. Inside the cavity, the support is removably coupled to the cavity for selectively increasing or decreasing a rigidity of the raised region of the insert in order to apply a user-selected therapeutic pressure.

8 Claims, 9 Drawing Sheets

(56) References Cited

U.S. PATENT DOCUMENTS 3,780,742 A * 12/1973 Madgy ..... A43B 7/142 36/147
3,861,399 A * 1/1975 Huff ..... A43B 7/142 36/72 B
4,739,765 A * 4/1988 Sydor ..... A43B 7/144 36/155
4,793,078 A * 12/1988 Andrews ..... A43B 7/28 36/43
RE33,648 E * 7/1991 Brown ..... A43B 13/12 36/44
5,768,803 A * 6/1998 Levy ..... A43B 17/02 36/43
6,176,025 B1 * 1/2001 Patterson ..... A43B 7/1445 36/35 B
6,315,786 B1 11/2001 Smuckler
7,506,459 B2 * 3/2009 Grisoni ..... A43B 7/1425 36/180
7,644,522 B2 * 1/2010 Ramirez ..... A43B 7/1415 36/160
7,707,751 B2 * 5/2010 Avent ..... A61F 5/14 36/150
7,757,321 B2 * 7/2010 Calvert ..... A47C 7/021 5/652
7,958,653 B2 * 6/2011 Howlett ..... A43B 17/023 36/44
8,453,346 B2 6/2013 Steszyn
8,667,709 B2 * 3/2014 Ellis ..... A43B 13/38 36/25 R
9,072,340 B2 * 7/2015 Huber ..... A43B 7/142
9,107,472 B2 * 8/2015 Donzis ..... A43B 7/148
9,380,828 B2 * 7/2016 Lee ..... A43B 7/145
9,554,616 B2 * 1/2017 Horesh ..... A43B 17/02
9,668,537 B2 * 6/2017 Pedersen ..... A43B 17/023
9,693,602 B2 7/2017 Trautmann
10,143,268 B2 12/2018 Romo
2004/0194348 A1 * 10/2004 Campbell ..... A43B 17/16 36/93
2006/0059726 A1 * 3/2006 Song ..... A43B 7/1435 36/142
2007/0124959 A1 * 6/2007 Meffan ..... A43B 17/04 36/43
2007/0245593 A1 * 10/2007 Yang ..... A43B 7/144 36/15
2007/0289170 A1 * 12/2007 Avent ..... A61F 5/14 36/173
2008/0289215 A1 * 11/2008 Park ..... A43B 13/145 36/28
2009/0260258 A1 * 10/2009 Spiegel ..... A43B 3/0031 36/44
2011/0099845 A1 5/2011 Miller
2013/0047462 A1 * 2/2013 Chang ..... A43B 7/223 36/43
2013/0192088 A1 * 8/2013 Veldman ..... A43B 7/144 36/44
2013/0219744 A1 * 8/2013 Case ..... A43B 7/142 36/43
2014/0259752 A1 * 9/2014 Feldman ..... A43B 7/1465 36/43
2015/0342295 A1 * 12/2015 Moon ..... A43B 7/146 36/43
2016/0338868 A1 11/2016 Grimes
2018/0042336 A1 * 2/2018 Lan ..... A43B 7/142
2019/0125032 A1 * 5/2019 Liu ..... A43B 7/143

* cited by examiner

DEVICE AND METHOD FOR TREATING HEEL PAIN

TECHNICAL FIELD OF THE INVENTION

The present invention relates in general to orthotic devices and methods of treating heel pain, and more specifically, to an orthotic device comprising an insert that may be worn in a shoe, the insert including a raised region that contacts the arch region of the wearer's foot that is proximate to the heel, which may be reinforced with a removable support attachment for selectively increasing or decreasing a rigidity of the raised region of the insert in order to apply a user-selected therapeutic pressure.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Heel pain is a common malady in the population, and a wide range of remedies, therapies, and therapeutic devices have been developed for and used by heel pain sufferers. Remedies may range from physical therapy to surgical procedures; in some cases, sufferers may use pharmaceuticals to alleviate heel pain. With respect to devices, several types of orthotic devices including inserts, gels, cushions and the like have been previously developed, which do not adequately address treatment of heel pain for many individuals.

The prior art includes several orthotic devices intended to treat heel pain of various types. Some devices are designed to support, immobilize, or hold the heel region of a wearer to minimize heel pain. Some devices claim to alleviate heel pain by cushioning or embracing the heel. Other devices are very complex and include leg braces with various immobilization features, elastic footwraps which provide compressive forces on the bottom of the foot, and orthotic insoles to be worn with shoes for arch support and heel cushioning. The problem with these devices is that they only provide temporary relief. As such, prior art devices provide some relief, but do not typically result in a pain-free experience for patients.

An example of a helpful device is described by U.S. Pat. No. 6,315,786. That device for treating heel pain is designed to apply a therapeutic pressure at a region of a wearer's foot. More specifically, that device is configured to apply an acupressure to the calcaneus-midtarsal connection area; properly applied acupressure in this area is known to alleviate heel pain. A shortcoming of this device however is that the acupressure applied by that device cannot be controlled by a user. That is, a user cannot adjust, change or alter the acupressure being applied because of the static structure of that device. For some users, a static device may not apply the right acupressure and thus the device may not function properly. Therefore, there are several problems with the current state of the art, which have not been adequately addressed.

Accordingly, there remains an unanticipated and unaddressed need for a device and method of treating heel pain that allows users or wearers to selectively increase or decrease an applied acupressure to apply a user-selected therapeutic pressure for alleviating heel pain. The problems persist because a need to provide an orthotic device for treating heel pain has not been adequately met. It is to these ends that the present invention has been developed.

SUMMARY OF THE INVENTION

To minimize the limitations in the prior art, and to minimize other limitations that will be apparent upon reading and understanding the present specification, the present invention describes an orthotic device for treating heel pain.

Generally, the present invention involves an orthotic device comprising an insert that may be worn in a shoe. The insert includes a raised region along a top surface of the insert that contacts an arch region of the wearer's foot proximate to the heel. The raised region may be selectively reinforced with a removable attachment or support for selectively increasing or decreasing a rigidity of the raised region of the insert in order to apply a user-selected therapeutic pressure.

In some exemplary embodiments, a perimetrical edge of the cavity is adapted to receive a perimetrical edge of the supplemental support so that each edge is secured with a friction fit. In some exemplary embodiments, fastening structures such as registering protrusions and apertures and disposed over the surfaces of the cavity and supplemental support so that the supplemental support may be securely coupled within the cavity.

A device for treating heel pain, in accordance with an exemplary embodiment of the present invention, may include: an insert adapted to be worn inside a shoe; a heel region situated at a distal end of the insert adapted to receive at least a region of a heel of a wearer; a raised region having a length situated along a width of the insert and adapted to underlie a calcaneus-midtarsal connection of a foot of the wearer, the raised region comprising a bottom surface with a semi-cylindrical cross-section defining a cavity below the raised region so that an apex of the semi-cylindrical cross-section lies above a bottom flat surface of the insert; and a removable supplemental support having with semi-cylindrical cross-section configured to snuggly fit within with the cavity below the raised region.

A device for treating heel pain, in accordance with another exemplary embodiment of the present invention, may include: an insert adapted to be worn inside a shoe; a heel region situated at a distal end of the insert adapted to receive at least a region of a heel of a wearer; a raised region having a length situated along a width of the insert and adapted to underlie a calcaneus-midtarsal connection of a foot the wearer, the raised region comprising a bottom surface with a semi-cylindrical cross-section defining a cavity below the raised region so that an apex of the semi-cylindrical cross-section lies above a bottom flat surface of the insert, the cavity including: a perimetrical boundary defined by an edge forming a height between the bottom flat surface of the insert and the bottom surface with the semi-cylindrical cross-section, and at least one aperture along a perimetrical area of the bottom surface with the semi-cylindrical cross-section; and a supplemental support region configured to removably couple to the cavity, including: a top surface with a complementary semi-cylindrical cross-section that contours and registers with the bottom surface with the semi-cylindrical cross-section, and at least one protrusion along a perimetrical area of the top surface adapted to register with the at least one aperture on the bottom surface.

A device for treating heel pain, in accordance with yet another exemplary embodiment of the present invention, may include: an insert adapted to be worn inside a shoe; a heel region situated at a distal end of the insert adapted to receive at least a region of a heel of a wearer; a raised region having a length situated along a width of the insert and adapted to underlie a calcaneus-midtarsal connection of a foot the wearer, the raised region comprising a bottom surface with a semi-cylindrical cross-section defining a cavity with a perimetrical edge forming a height between a bottom flat surface of the insert and the bottom surface with the semi-cylindrical cross-section, so that an apex of the bottom semi-cylindrical surface lies above the bottom flat surface of the insert; and a supplemental support region configured to removably couple to the cavity, wherein the supplemental support includes a top surface with a complimentary semi-cylindrical cross-section that contours and registers with the bottom surface.

Various objects and advantages of the present invention will become apparent from the following description taken in conjunction with the accompanying drawings wherein are set forth, by way of illustration and example, certain embodiments of this invention. The drawings submitted herewith constitute a part of this specification, include exemplary embodiments of the present invention, and illustrate various objects and features thereof.

BRIEF DESCRIPTION OF DRAWINGS

Elements in the figures have not necessarily been drawn to scale in order to enhance their clarity and improve understanding of these various elements and embodiments of the present invention. Furthermore, elements that are known to be common and well understood to those in the industry are not depicted in order to provide a clear view of the various embodiments of the invention.

DESCRIPTION OF THE INVENTION

Figure 1:
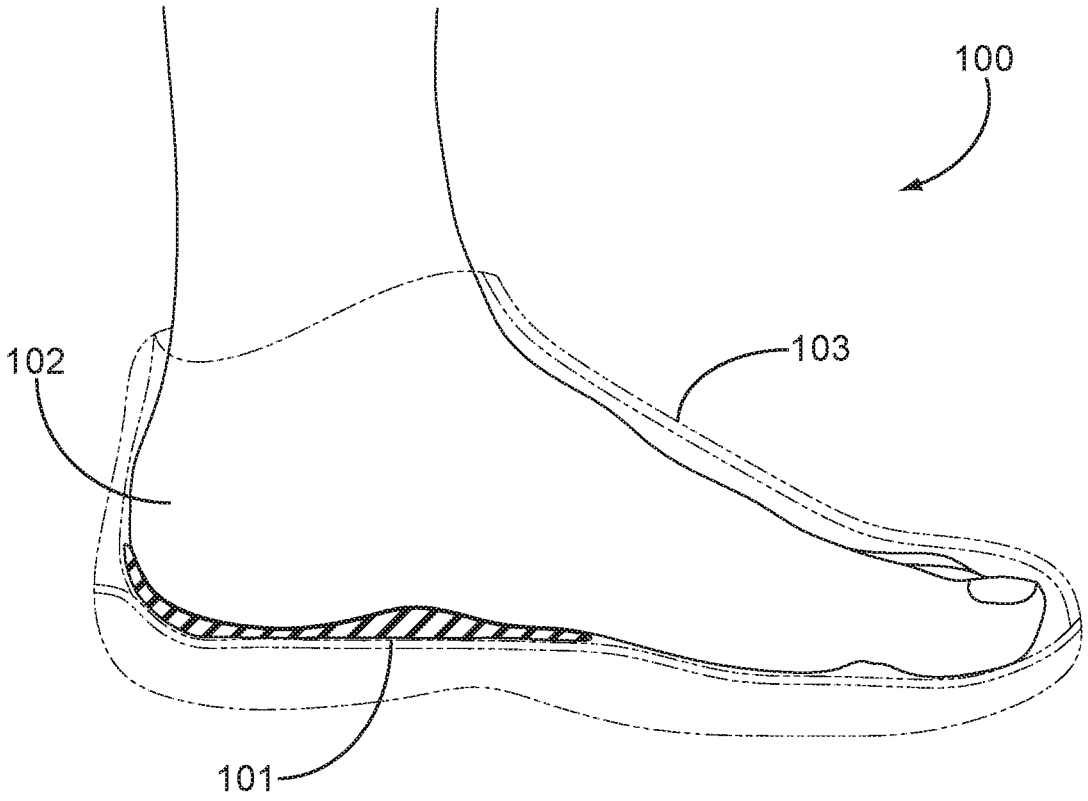
FIG. 1 (PRIOR ART)
FIG. 1 illustrates a cross-sectional view of a prior art orthotic device for treating heel pain worn by a user.

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized, and changes may be made without departing from the scope of the invention. Wherever possible, the same reference numbers are used in the drawings and the following description to refer to the same or similar elements.

In the following detailed description, numerous specific details are set forth by way of examples in order to provide a thorough understanding of the relevant teachings. However, it should be apparent to those skilled in the art that the present teachings may be practiced without such details. In other instances, well known structures, components and/or functional or structural relationship thereof, etc., have been described at a relatively high-level, without detail, in order to avoid unnecessarily obscuring aspects of the present teachings.

Throughout the specification and claims, terms may have nuanced meanings suggested or implied in context beyond an explicitly stated meaning. Likewise, the phrase "in one embodiment/example" as used herein does not necessarily refer to the same embodiment and the phrase "in another embodiment/example" as used herein does not necessarily refer to a different embodiment. It is intended, for example, that claimed subject matter include combinations of example embodiments in whole or in part.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and or steps. Thus, such conditional language is not generally intended to imply that features, elements and or steps are in any way required for one or more embodiments, whether these features, elements and or steps are included or are to be performed in any particular embodiment.

The terms "comprising," "including," "having," and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present. The term "and or" means that "and" applies to some embodiments and "or" applies to some embodiments. Thus, A, B, and or C can be replaced with A, B, and C written in one sentence and A, B, or C written in another sentence. A, B, and or C means that some embodiments can include A and B, some embodiments can include A and C, some embodiments can include B and C, some embodiments can only include A, some embodiments can include only B, some embodiments can include only C, and some embodiments include A, B, and C. The term "and or" is used to avoid unnecessary redundancy. Similarly, terms, such as "a, an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

While exemplary embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of the invention or inventions disclosed herein. Accordingly, the following detailed description does not limit the disclosure. Instead, the proper scope of the disclosure is defined by the appended claims.

Turning now to the figures, FIG. 1 illustrates a cross-sectional view of a prior art orthotic device for treating heel pain worn by a user. More specifically, device 100 includes an insert 101 that may be worn by a wearer so that it sits below the wearer's heel 102. Device 100 typically includes a region 101*a* that is raised and position to fit in an arch region of the wearer's foot. Device 100 is configured to apply an acupressure to the calcaneus-midtarsal connection area, which is known to alleviate heel pain. A shortcoming of this device however is that the acupressure applied by device 100 cannot be controlled by a user. That is, a user cannot adjust, change or alter the acupressure being applied because of the static structure of that device.

Figure 2:
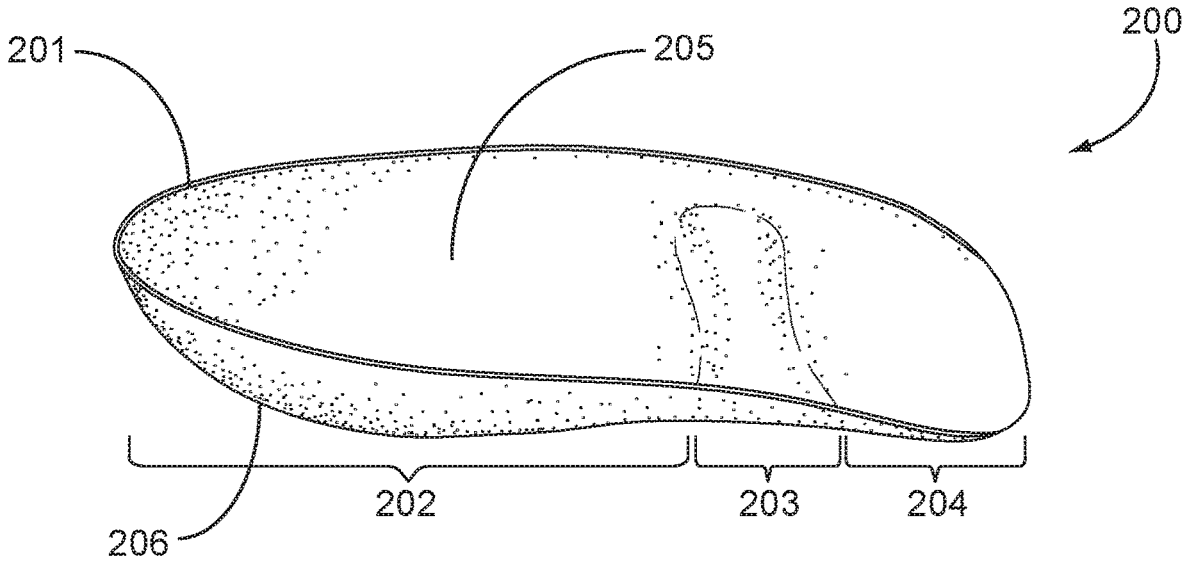
FIG. 2 illustrates a perspective view of an orthotic device for treating heel pain in accordance with an exemplary embodiment of the present invention.
Figure 3:
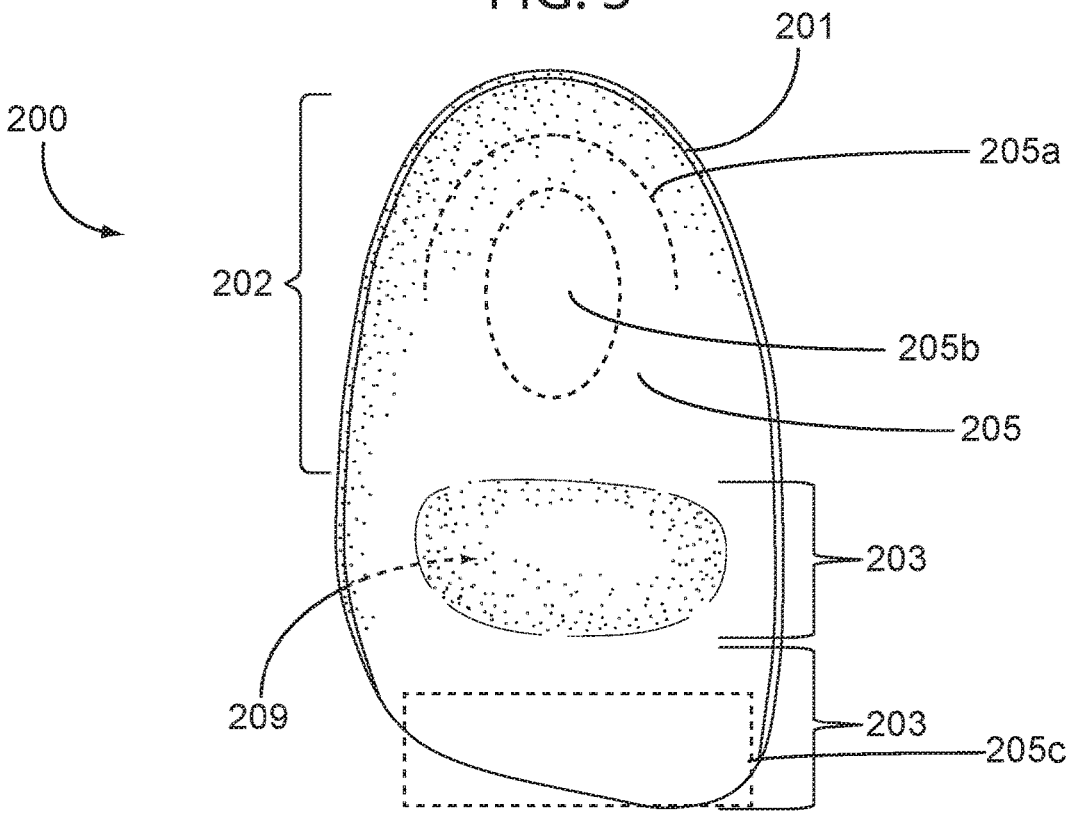
FIG. 3 illustrates a top view of an orthotic device for treating heel pain in accordance with an exemplary embodiment of the present invention.

Turning now to the next figures, FIG. 2 illustrates a perspective view of an orthotic device for treating heel pain in accordance with an exemplary embodiment of the present invention, and FIG. 3 illustrates a top view thereof. More specifically, FIG. 2 and FIG. 3 depict orthotic device 200 for treating heel pain, which may include an insert 201 having a heel region 202, a raised region 203, and a partial sole region 204. Moreover, below the raised region 203, an attachment or supplemental support 209 (better illustrated in other figures discussed below) may be removably coupled to insert 201 in order to facilitate a wearer to selectively increasing or decreasing a rigidity of the raised region 203 of the insert 201 in order to apply a user-selected therapeutic pressure.

Insert 201 forms the body of device 200 and is generally shaped as a partial insert that does not necessarily extend an entire length of a wearer's foot but may be instead adapted to rest bellow the medial ball region of a foot. In exemplary embodiments, insert 201 includes a material that may be manufactured in the illustrated configuration through thermo-forming or injection molding.

In exemplary embodiments materials for insert 201 may include but are not limited to plastics, gels, foams Such as P-lite® or polypropylene, visco-elastic polymer, Softsole®, polyurethane, and combinations thereof. In exemplary embodiments, different hardness may be employed for insert 201, but in some exemplary embodiments, insert 201 may include a hardness between 10 to 80 durometers. This hardness has been found to apply appropriate pressure to the patient's foot, without causing discomfort.

Insert 201 generally includes heel region 202, a raised region 203, and a partial sole region 204. Insert 201 typically includes an interior or top surface 205 that is adapted to contact the bottom surface of a wearer's foot, and an exterior or bottom surface 206 adapted to contact an interior surface of a wearer's shoe. As will be discussed further below, insert 201 may include regions with varying hardness, and as such heel region 202 may have one or more regions (within heel region 202) with different hardness levels, partial sole region 204 may have a different hardness than heel region 202 and or different hardness regions within partial sole region 204, and so on without limiting the scope of the present invention.

Heel region 202 is generally adapted to receive a region of a wearer's heel. Heel region 202 may be shaped as a type of heel cup situated posterior in relation to raised region 203. In this region, in some exemplary embodiments, heel region 202 may include a region 205*a* that may be a harder or more rigid region than a region 205*b*, which may be a softer less rigid region. While region 205*a* is adapted to sit against an outer region of a wearer's heel, region 205*b* is adapted to sit just below the bottom region of a wearer's heel. This ensures that the wearer's heel sits comfortably in the cup section of insert 201, and also that the wearer's heel is adequately supported by the more rigid region 205*a*.

Raised region 203 may typically include a length that is situated along a width of the insert 201 and closer to the anterior end of insert 201 than to the posterior end of insert 201. Raised region 203 may be adapted to underlie a calcaneus-midtarsal connection of a foot of the wearer and generally lies below an arch region of the wearer's foot. Raised region 201 is further defined by a bottom surface having a semi-cylindrical cross-section, below which a cavity 207 is formed so that an apex of the bottom surface with the semi-cylindrical cross-section lies above a bottom flat section (206*a*) of the outer surface 206 of insert 201. A discussion below, including with reference to FIG. 9-FIG. 10, will further address the shape of raised region 202 in accordance with some exemplary embodiments of the present invention.

Partial sole region 204 lies anterior to raised region 202 and is adapted to sit approximately below the medial ball region of a wearer's foot. In exemplary embodiments, this region includes a region 205*c* that is less rigid and more flexible than the remainder of insert 201 to ensure that insert 201 comfortably sits below the wearer's foot; for example, too rigid, and insert 201 may not sit comfortably beneath the foot against the sole or interior region of a shoe.

Supplemental support 209 (see also FIG. 4-FIG. 7, for example) generally sits below the raised region 203 and may be removably coupled to insert 201 in order to facilitate a wearer to selectively increasing or decreasing a rigidity of the raised region 203 of the insert 201 in order to apply a user-selected therapeutic pressure. In some exemplary embodiments, supplemental support 209 may be constructed so that it has a hardness that is equal to raised region 203. In some exemplary embodiments, supplemental support 209 may be constructed so that it has a hardness that is less than a hardness of raised region 203. In some exemplary embodiments, supplemental support 209 may be constructed so that it has a hardness that is greater than a hardness of raised region 203. Typically, as will be discussed with reference to the following figures, supplemental support 209 sits within a cavity 207 that is formed by a bottom surface of raised region 203. This way, when supplemental support 209 is removed from the cavity 207 at least partially defining raised region 203, an acupressure applied by raised region 203 may be selectively decreased.

Accordingly, in some exemplary embodiments, orthotic device 200 for treating heel pain, may include an insert 201 adapted to be worn inside a shoe; a heel region 202 situated at a distal end of the insert 201 adapted to receive at least a region of a heel of a wearer; a raised region 203 having a length situated along a width of the insert 201 and adapted to underlie a calcaneus-midtarsal connection of a foot the wearer, the raised region 203 comprising a bottom surface with a semi-cylindrical cross-section defining a cavity 207 below the raised region so that an apex of the bottom surface with the semi-cylindrical cross-section lies above a bottom flat surface (206*a*) of the insert; and a supplemental support 209 configured to removably couple to the cavity 207.

Figure 4:
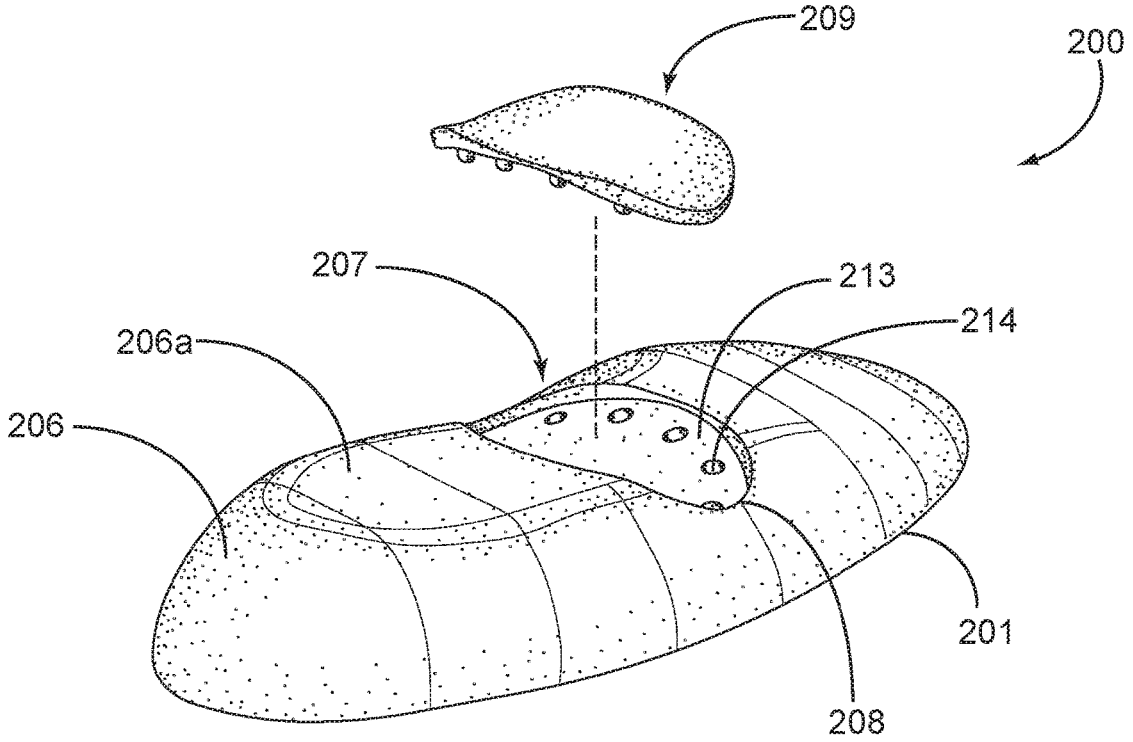
FIG. 4 illustrates an exploded bottom perspective view of an orthotic device for treating heel pain in accordance with an exemplary embodiment of the present invention.
Figure 5:
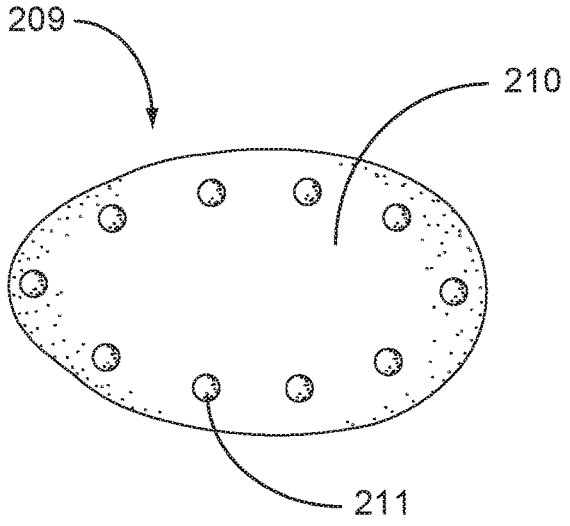
FIG. 5 illustrates a bottom view of a supplemental support attachment for an orthotic device in accordance with the present invention.

Turning now to the next set of figures, FIG. 4 illustrates an exploded bottom perspective view of an orthotic device for treating heel pain in accordance with an exemplary embodiment of the present invention; FIG. 5 illustrates a bottom view of the supplemental support attachment; and FIG. 6 illustrates a bottom perspective view of the supplemental support attachment thereof.

More specifically, FIG. 4 shows the bottom of insert 201 with supplemental support 209 detached from insert 201. Insert 201 as mentioned above includes a bottom surface 206. Bottom surface 206 includes a flat region 206*a*, which generally is adapted to lie or sit against an interior sole region of a shoe. Anterior to the flat region 206*a*, cavity 207 lies beneath raised region 203. Cavity 207 may include an edge 208 that forms a perimeter of cavity 207, and a surface 213 that is typically a surface having a semi-circular cross-section as will be discussed further below. Proximate to an interior region of the edge 208, along surface 213, a plurality of apertures 214 may be disposed such as to facilitate coupling with or registering with a region of supplemental support 209.

Figure 6:
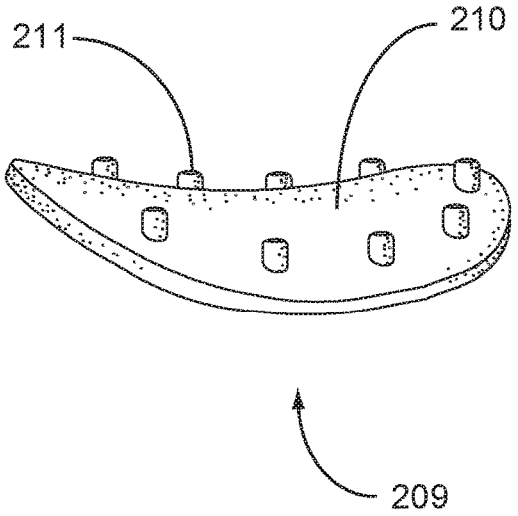
FIG. 6 illustrates a bottom perspective view of a supplemental support attachment for an orthotic device in accordance with the present invention.

FIG. 5 and FIG. 6 illustrate bottom views of supplemental support 209. From these views it may be appreciated that supplemental support 209 includes a top surface 210 that is adapted to sit against the interior or bottom surface of 213 of cavity 207 of insert 201. Top surface 210 is generally curved and has a semi-circular cross section with a flat bottom edge along a bottom surface 212 that is configured to be flush with bottom surface 206 of insert 201. However, the entire shape of supplemental support 209 is curved and may be generally oval from a top or bottom view. In exemplary embodiments, surface 210 of supplemental support 209 may include at least one or a plurality of protrusions 211 arranged along a perimetrical area of the top surface 210 adapted to register with the at least one aperture on the bottom semi-cylindrical surface of the insert that defines the cavity 207.

Figure 7:
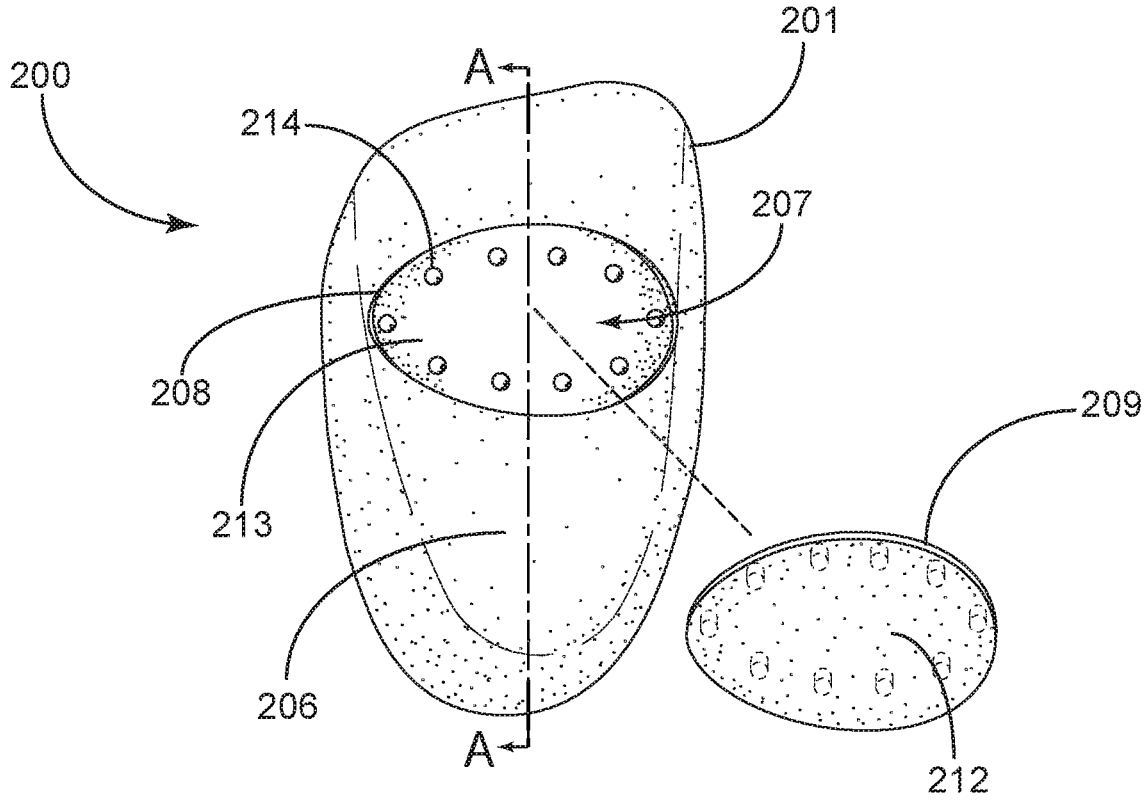
FIG. 7 illustrates an exploded bottom view of an orthotic device for treating heel pain in accordance with an exemplary embodiment of the present invention.

Turning to the next figure, FIG. 7 illustrates an exploded bottom view of an orthotic device for treating heel pain in accordance with an exemplary embodiment of the present invention. From these views, it may be appreciated that bottom surface 212 of supplemental support 209 may be generally elliptical. Accordingly, in such embodiments, perimeter 208 along surface 206 of insert 201 may have the same general elliptical shape so that when supplemental support 209 registers with insert 201 to sit inside cavity 207, orthotic device 200 will have a flush bottom surface defied by surface 206 (including its flat region 206*a*) and surface 212 of supplemental support 209, whenever supplemental support 209 is coupled to insert 201. Because in some embodiments, including the embodiment presently shown, surface 210 of supplemental support 209 may include at least one or a plurality of protrusions 211 arranged along a perimetrical area of the top surface 210, surface 213 of cavity 207 may complementarily include at least one or a plurality of apertures on the bottom semi-cylindrical surface (surface 213) of the insert 201 that defines the cavity 207 so that supplemental support 209 may securely register with insert 201.

Figure 8:
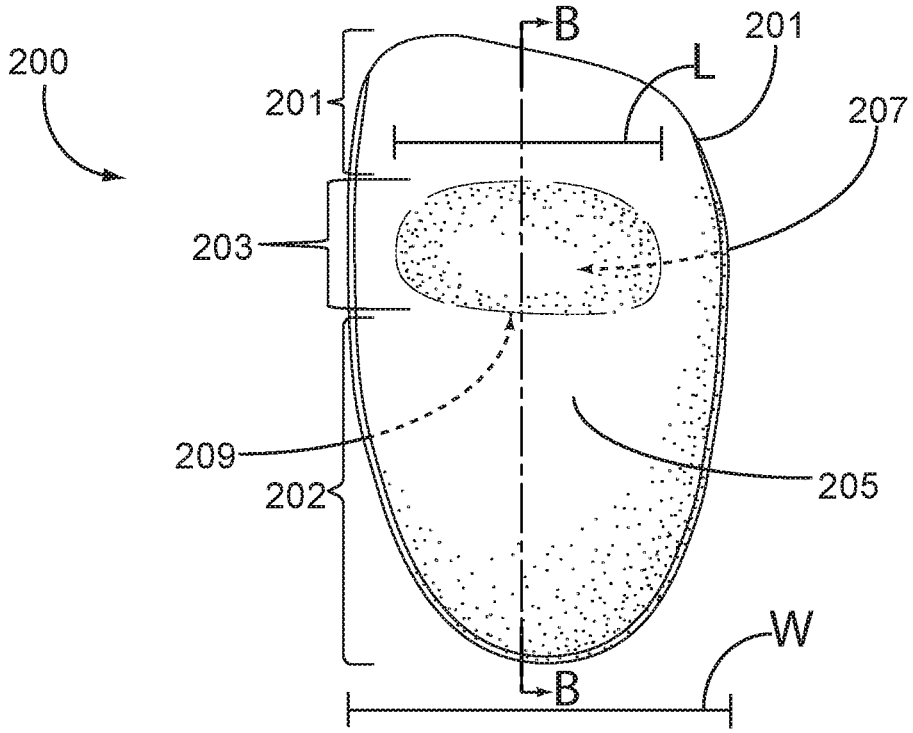
FIG. 8 illustrates a top view of an orthotic device for treating heel pain in accordance with an exemplary embodiment of the present invention.

Turning now to FIG. 8, a top view of orthotic device 200 showing supplemental support 209 sitting inside cavity 207 is illustrated. From this view, it may be appreciated that the heel region 202 is generally the larger of the three regions. Moreover, from this view it may also be appreciated that, as mentioned above, a length L of the raised region 203 may be positioned along a width W of the insert 201. Similarly, a length L of the supplemental support 209 may be arranged or positioned along the width W of the insert 201 to register along the raised region 203 of device 200. The cross-sectional views along line segments A-A and B-B shown in FIG. 7 and FIG. 8 are discussed in turn.

Figure 9:
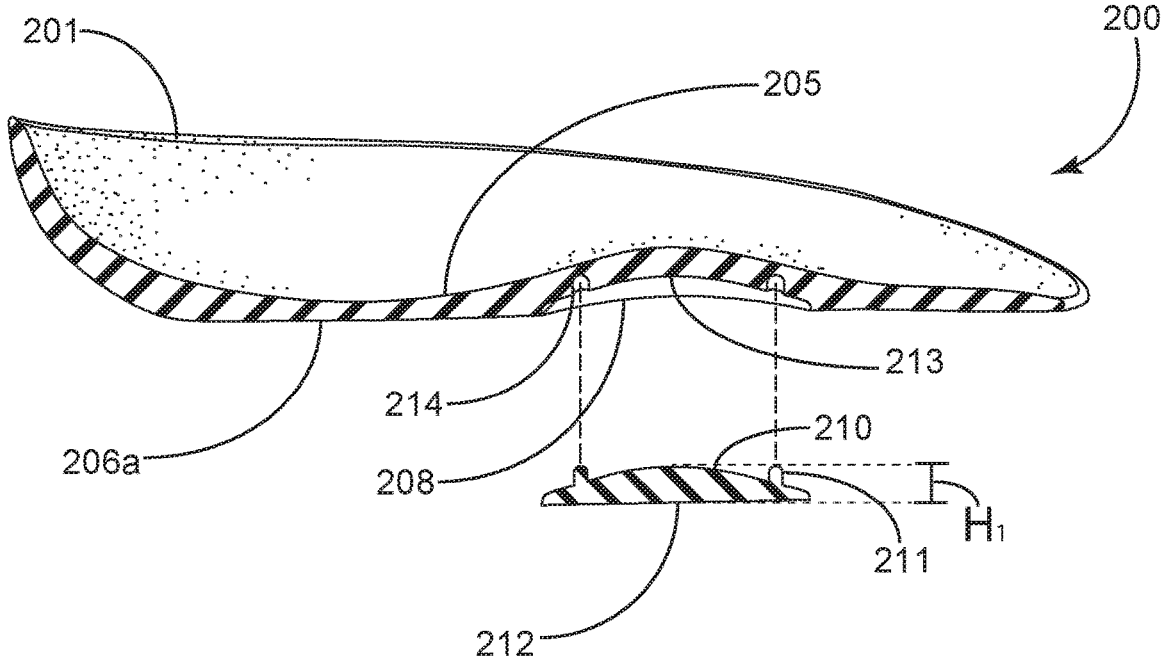
FIG. 9 illustrates an exploded cross-sectional view of an orthotic device for treating heel pain in accordance with an exemplary embodiment of the present invention, a supplemental support attachment shown decoupled from the orthotic device.
Figure 10:
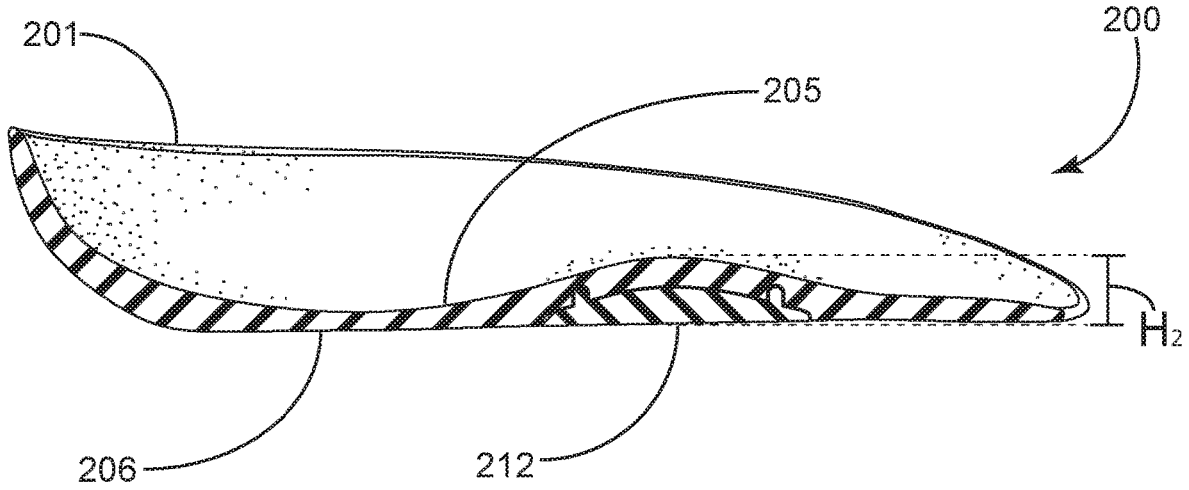
FIG. 10 illustrates an exploded cross-sectional view of an orthotic device for treating heel pain in accordance with an exemplary embodiment of the present invention, a supplemental support attachment shown coupled to the orthotic device.

FIG. 9 illustrates an exploded cross-sectional view of orthotic device 200, the cross-sectional view along line segment A-A, showing supplemental support 209 decoupled from the insert 201 of orthotic device 200. FIG. 10 illustrates a cross-sectional view of orthotic device 200, the cross-sectional view along line segment B-B, in which the supplemental support 209 is shown coupled to the orthotic device. From these views, it may be appreciated that the raised region 202 comprises a bottom surface 213 that includes a semi-cylindrical cross-section, the semi-cylindrical cross section defining the cavity 207 below the raised region 203 so that an apex of the bottom surface 213 that includes a semi-cylindrical cross-section lies above the bottom flat surface 206*a* of the insert 201. The supplemental support region 209 includes a top surface 210 having a complementary semi-cylindrical cross-section that contours and registers with the bottom surface 213 of the insert 201.

In exemplary embodiments, such as the one shown in these views, the supplemental support 209 of orthotic device 200 includes a plurality of protrusions 211 along a perimetrical area of the top surface 210 adapted to register with a plurality of apertures 214 on the bottom surface 213 of the insert 201.

In some exemplary embodiments, the thickness of the raised region 203 including supplemental support 209 is between 0.0625 inches and 0.375 inches. In some exemplary embodiments, the thickness of the raised region 203 combined with the supplemental support 209 may have a height $H_2$ as high as 1 cm. In some exemplary embodiments, the thickness of the raised region 203 combined with the supplemental support 209 may have a height $H_2$ as high as 3 cm. In some exemplary embodiments, the thickness of the raised region 203 combined with the supplemental support 209 may have a height $H_2$ as high as 4 cm. In exemplary embodiments, the range for the thickness of the raised region 203 excluding supplemental support 209 may be between 1 mm and 5 mm. In some exemplary embodiments, the thickness of the raised region 203 excluding supplemental support 209 may have a height $H_1$ as 1 mm. In some exemplary embodiments, the thickness of the raised region 203 excluding supplemental support 209 may have a height $H_1$ as 5 mm.

In some exemplary embodiments, the range for the length and width of the raised region 203 may be as large as 7 cm and 4 cm, respectively. In some exemplary embodiments, the length of the raised region 203 is between 0.5 inches and 2.5 inches.

In some exemplary embodiments, the hardness of the raised region 203 including the supplemental support 209 is between 10 A to 80 using a durometer method. In some exemplary embodiments, the hardness of the raised region 203 is the same as the hardness of the supplemental support 209. In some exemplary embodiments, the hardness of the raised region 203 is greater than the hardness of the supplemental support 209. In some exemplary embodiments, the hardness of the raised region 203 is less than the hardness of the supplemental support 209.

In some embodiments, different supplemental supports similar to supplemental support 209 may be provided with a varying hardness for users to select from. In other exemplary embodiments, only a single hardness is provided with an orthotic device, but the insert of the device may be offered in different hardness models. It is noted that variations of the present invention may be possible, and these are just examples that are not meant as limiting examples nor deviations from the scope of the present invention. In exemplary embodiments, when the supplemental support 209 is removed from the cavity below raised region 203, a lesser acupressure is applied to the region of the foot.

Figure 11A:
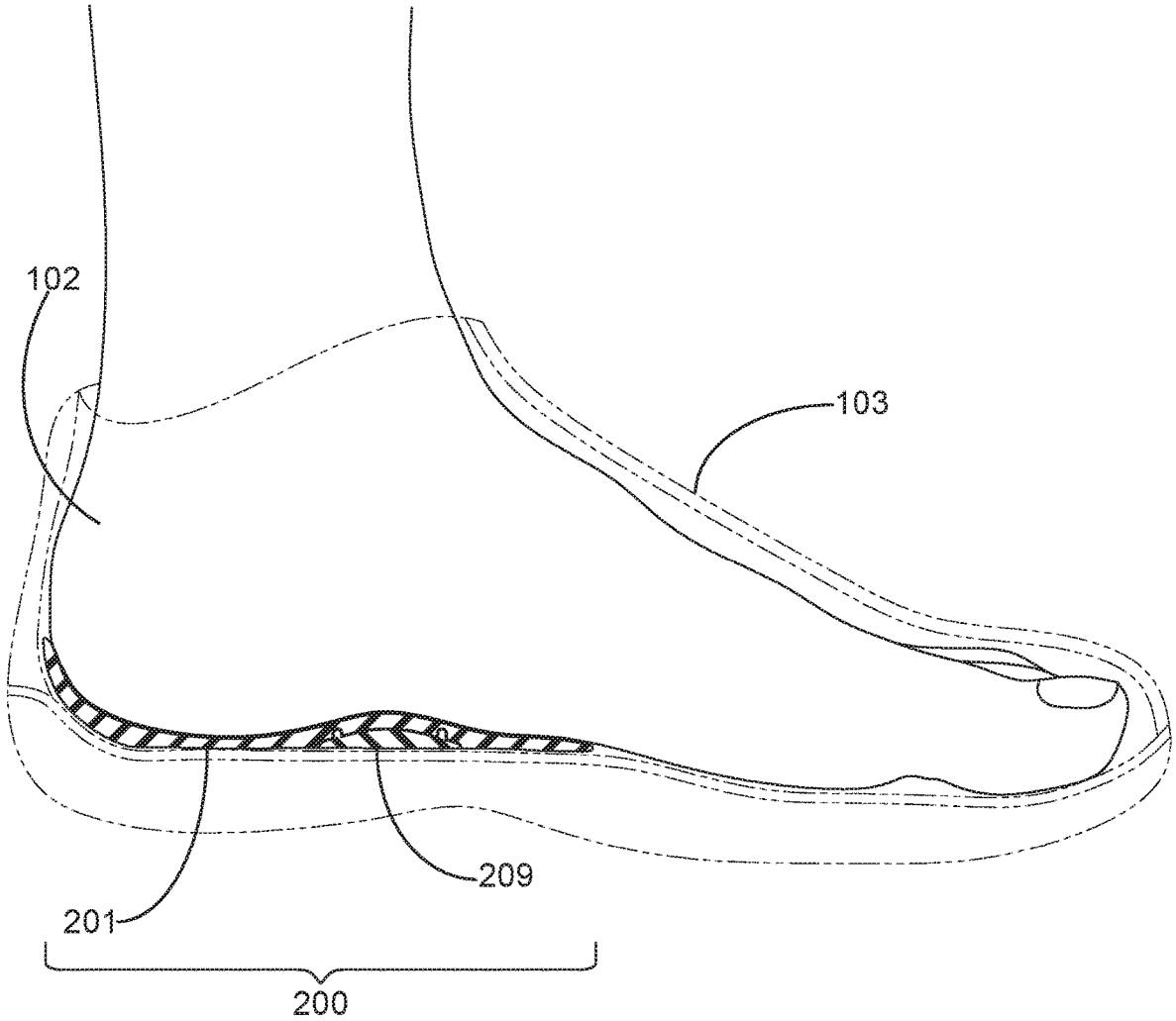
FIG. 11A illustrates a cross-sectional view of an orthotic device for treating heel pain in accordance with the present invention, worn by a user; in this instance a supplemental support attachment coupled to the orthotic device while in use.
Figure 11B:
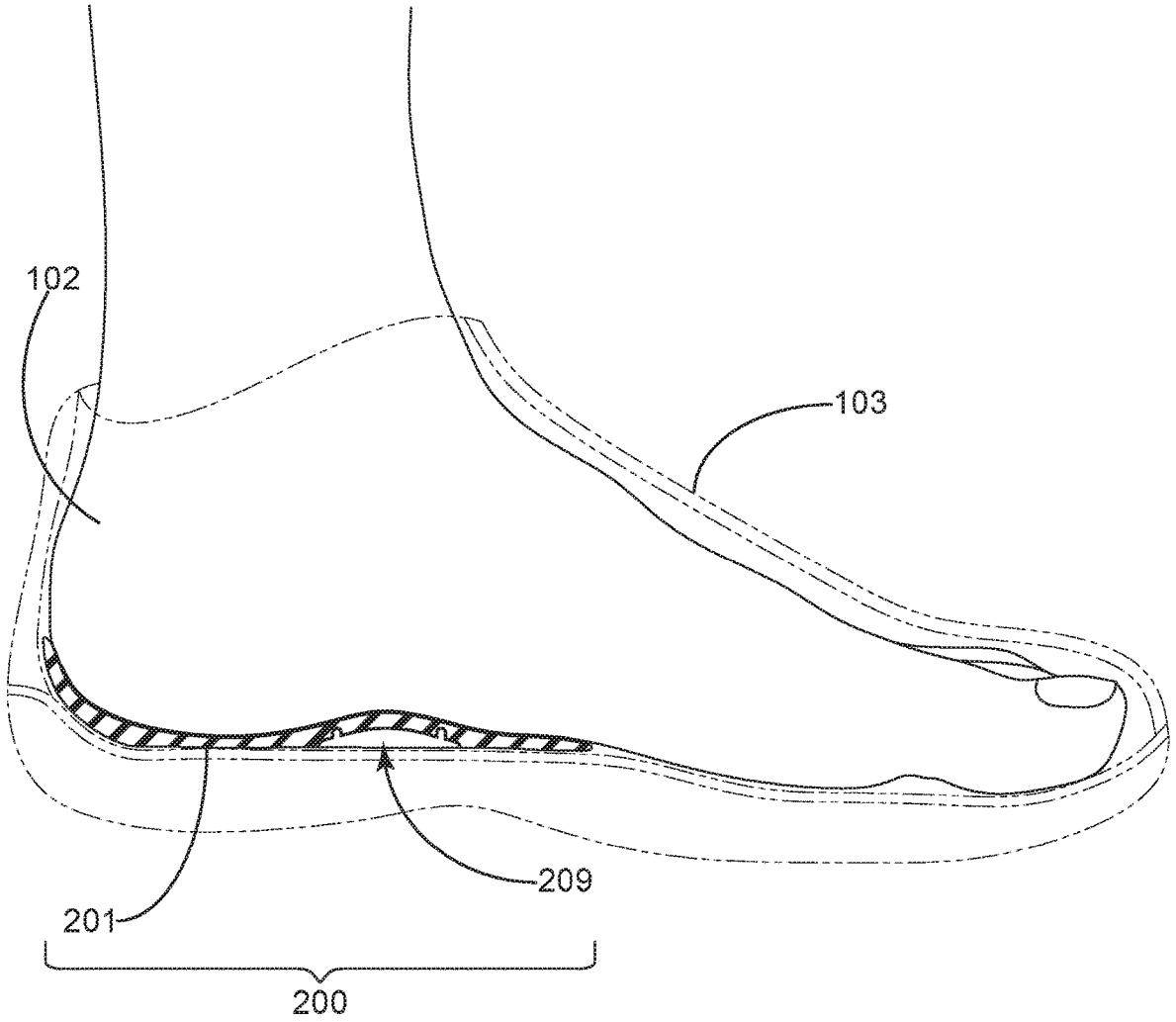
FIG. 11B illustrates a cross-sectional view of an orthotic device for treating heel pain in accordance with the present invention, worn by a user; in this instance a supplemental support attachment decoupled from the orthotic device while in use.

Turning now to the next figures, FIG. 11A illustrates a cross-sectional view of orthotic device 200 for treating heel pain in accordance with the present invention, worn by a user with supplemental support 209 coupled to orthotic device 200 while in use; FIG. 11B illustrates a cross-sectional view of orthotic device 200 for treating heel pain in accordance with the present invention, worn by a user with supplemental support 209 decoupled from orthotic device 200 while in use. As may be appreciated from these views, when device 200 is worn by user with supplemental support 200 coupled thereto, the user will received an applied acupressure that is greater than an applied acupressure when supplemental support 200 is decoupled from insert 201 of device 200, because the space (or lack of additional support) within cavity 207 defining raised region 203 will naturally make for a less rigid raised region 203. Accordingly, a user or wearer is enabled to selectively increase or decrease a rigidity of the raised region 203 of the insert 201 in order to apply a user-selected therapeutic pressure or acupressure at the target region.

Figure 12:
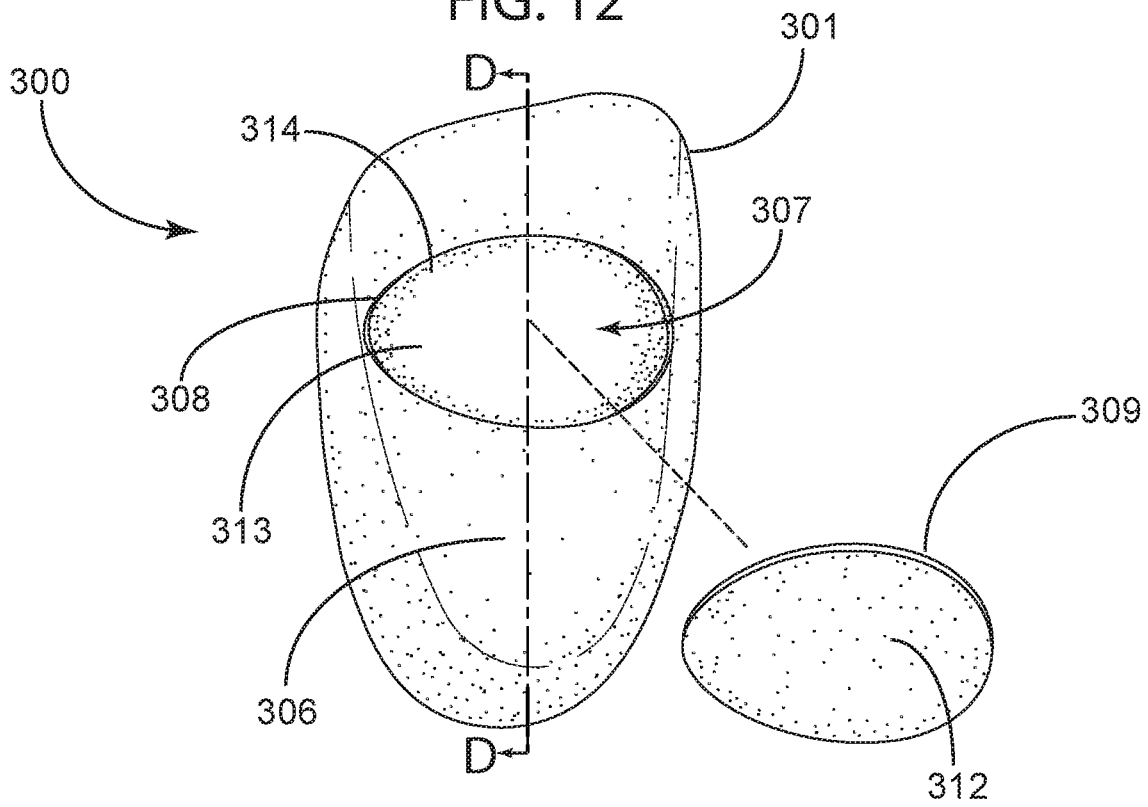
FIG. 12 illustrates an exploded bottom view of an orthotic device for treating heel pain in accordance with an exemplary embodiment of the present invention.
Figure 13:
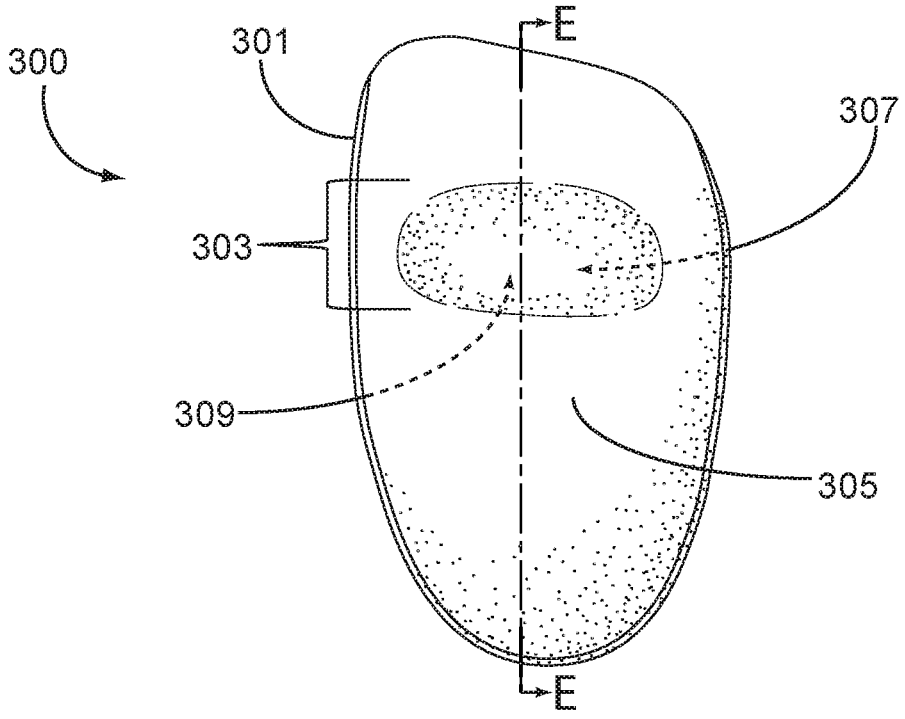
FIG. 13 illustrates a bottom view of an orthotic device for treating heel pain in accordance with an exemplary embodiment of the present invention.
Figure 14:
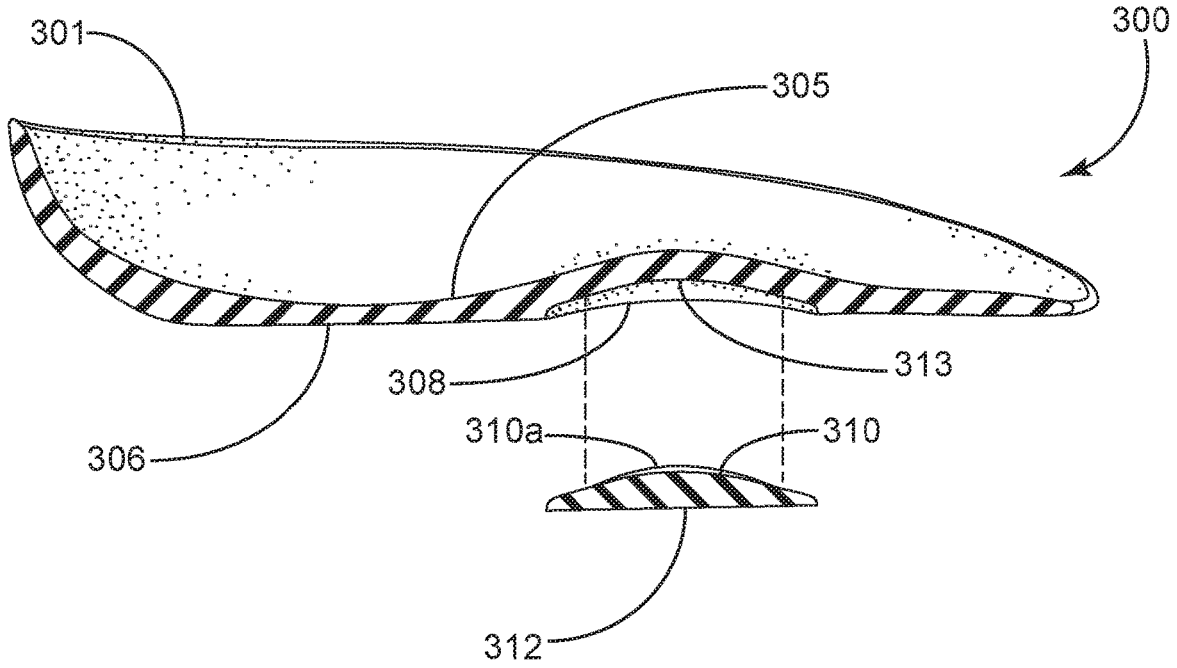
FIG. 14 illustrates an exploded cross-sectional view of an orthotic device for treating heel pain in accordance with an exemplary embodiment of the present invention, a supplemental support attachment shown decoupled from the orthotic device.
Figure 15:
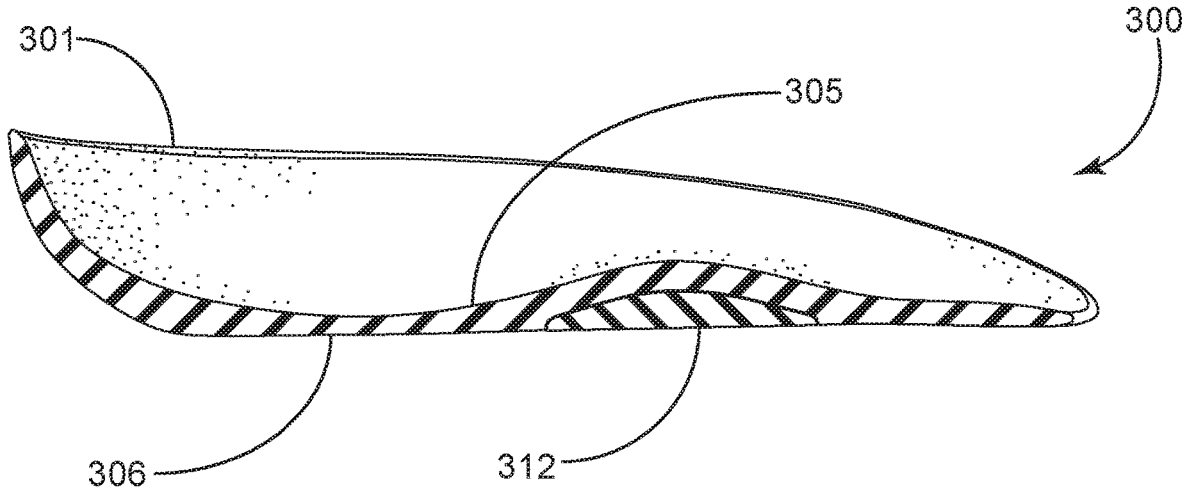
FIG. 15 illustrates an exploded cross-sectional view of an orthotic device for treating heel pain in accordance with an exemplary embodiment of the present invention, a supplemental support attachment shown coupled to the orthotic device.

As mentioned above, various embodiments of the present invention may be possible. For example, and without limiting the scope of the present invention, FIG. 12 illustrates an exploded bottom view of an orthotic device 300, which includes a supplemental support 309 that is similarly removably coupled to the device 300 but that uses a different means of being secured therein. FIG. 13 illustrates a bottom view thereof. More specifically, these views show orthotic device 300, which is very similar to orthotic device 200, and includes insert 301 with a raised region 303, the insert 301 including a top or interior surface 305 and a bottom or exterior surface 306 with a cavity 307 disposed therein right below raised region 303. The cavity 307 similarly includes a bottom surface 313 that is adapted to receive a top surface 310 of supplemental support 309. Rather than utilizing protrusions 211 and apertures 214 however, in this embodiment, a perimetrical edge 308 of cavity 307 and a perimetrical edge of supplemental support 309 may be configured so that a perimeter formed by perimetrical edge 308 is just slightly greater than a perimeter of supplemental support 309 so that supplemental support 309 snuggly and securely fits within cavity 307 by means of a frictional force between the two components. The cross-sectional views along line segments D-D and E-E are shown in FIG. 14 and FIG. 15.

In some exemplary embodiments, alternative and or combinations of different means of securing support 309 to insole 301 may be employed. For example, and without deviating from or limiting the scope of the present invention, fastening means for securing support 309 to insole 301 may include other types of fasteners, registering components (similar in shape as the protrusions and apertures depicted with reference to some of the figures above or with varying shapes), friction-fit edges, as well as adhesives, glue, or any other type of fastening means may be employed without deviating from the scope of the present invention. In some exemplary embodiments, in addition to or alternative to a configuration of perimetrical edge 308 and a perimetrical edge forming the perimeter of supplemental support 309, top surface 310 of supplemental support 309 and or bottom surface 313 of the cavity 307 of insert 301 may include an adhesive layer 310*a* so that supplemental support 309 may securely adhere to insert 301. In some exemplary embodiments, in addition to or alternative to a configuration of perimetrical edge 308 and a perimetrical edge forming the perimeter of supplemental support 309, a lockable means may be employed so that supplemental support 309 may securely couple with insert 301 and cannot be release without turning or otherwise actuating a mechanical means of releasing supplemental support 309 from insert 301.

An orthotic device for treating heel pain has been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching without departing from the spirit of the invention.

What is claimed is:

1. An orthotic device for treating heel pain, comprising:

an insert adapted to be worn inside a shoe;

a heel region situated at a distal end of the insert adapted to receive at least a region of a heel of a wearer;

a raised region having a length situated along a width of the insert and adapted to underlie a calcaneus-midtarsal connection of a foot of the wearer, the raised region comprising a bottom surface with a semi-cylindrical cross-section defining a cavity below the raised region so that an apex of the semi-cylindrical cross-section lies above a bottom flat surface of the insert, and wherein a thickness of the raised region is between 0.0625 inches and 0.375 inches, a hardness of the raised region is between 10 to 80, and the length of the raised region is between 0.5 inches and 2.5 inches;

the cavity including:

a perimetrical boundary defined by an edge forming a height between the bottom flat surface of the insert and the bottom surface with the semi-cylindrical cross-section, and at least one aperture of a plurality of apertures along a perimetrical area of the bottom surface with the semi-cylindrical cross-section; and a supplemental support configured to removably couple to the cavity, including:

a top surface with a semi-cylindrical cross-section that contours and registers with the bottom surface with the semi-cylindrical cross-section, and a plurality of protrusions along a perimetrical area of the top surface of the supplemental support, wherein the plurality of protrusions are removably connected to the plurality of apertures on the bottom surface of the raised region;

wherein the top surface of the supplemental support is adapted to register with the bottom surface of the raised region;

wherein a length of the insert is adapted to rest below the medial ball region of the wearers foot, and wherein the top surface having a flat bottom edge along the bottom surface that is configured to be flush with bottom surface of the insert.

2. The orthotic device of claim 1, wherein the supplemental support including the top surface and the semi-cylindrical cross-section contours and registers with the cavity of the insert.

3. The orthotic device of claim 1, wherein the cavity includes the perimetrical boundary defined by the edge with the height between the cavity and the bottom flat surface of the insert.

4. The orthotic device of claim 1, wherein a perimetrical edge of the cavity is adapted to receive a perimetrical edge of the supplemental support so that each edge is secured with a friction fit.

5. The orthotic device of claim 1, further comprising an adhesive on the top surface of the supplemental support for securing the supplemental support to the bottom surface of the raised region of the insert.

6. An orthotic device for treating heel pain, comprising:

an insert adapted to be worn inside a shoe;

a heel region situated at a distal end of the insert adapted to receive at least a region of a heel of a wearer;

a raised region having a length situated along a width of the insert and adapted to underlie a calcaneus-midtarsal connection of a foot the wearer, the raised region comprising a bottom surface with a semi-cylindrical cross-section defining a cavity with a perimetrical edge forming a height between a bottom flat surface of the insert and the bottom surface with the semi-cylindrical cross-section, so that an apex of the bottom semi-cylindrical surface lies above the bottom flat surface of the insert, and wherein a thickness of the raised region is between 0.0625 inches and 0.375 inches, a hardness of the raised region is between 10 to 80, and the length of the raised region is between 0.5 inches and 2.5 inches;

the cavity including:

a perimetrical boundary defined by an edge forming a height between the bottom flat surface of the insert and the bottom surface with the semi-cylindrical cross-section, and at least one aperture along a perimetrical area of the bottom surface with the semi-cylindrical cross-section; and a supplemental support configured to removably couple to the cavity, including:

a top surface with a semi-cylindrical cross-section that contours and registers with the bottom surface with the semi-cylindrical cross-section, and a plurality of protrusions along a perimetrical area of the top surface of the supplemental support, wherein the plurality of protrusions are removably connected to the plurality of apertures on the bottom surface of the raised region;

wherein the top surface of the supplemental support is adapted to register with the bottom surface of the raised region;

wherein a length of the insert is adapted to rest below the medial ball region of the wearers foot, and wherein the top surface having a flat bottom edge along the bottom surface that is configured to be flush with bottom surface of the insert.

7. The orthotic device of claim 6, wherein the perimetrical edge of the cavity is adapted to receive a perimetrical edge of the supplemental support so that each edge is secured with a friction fit.

8. The orthotic device of claim 6, further comprising an adhesive on the top surface of the supplemental support for securing the supplemental support to the bottom surface of the raised region of the insert.

* * * * *